US007924223B1

(12) United States Patent
Chang

(10) Patent No.: US 7,924,223 B1
(45) Date of Patent: Apr. 12, 2011

(54) SATELLITE GROUND TERMINAL INCORPORATING A SMART ANTENNA THAT REJECTS INTERFERENCE

(76) Inventor: Donald C. D. Chang, Thousand Oaks, CA (US)

( * ) Notice: Subject to any disclaimer, the term of this patent is extended or adjusted under 35 U.S.C. 154(b) by 117 days.

(21) Appl. No.: 11/999,996

(22) Filed: Dec. 6, 2007

(51) Int. Cl.
*H01Q 3/00* (2006.01)

(52) U.S. Cl. ..... 342/359; 342/372; 342/377

(58) Field of Classification Search ..... 342/359, 342/372, 377
See application file for complete search history.

(56) References Cited

U.S. PATENT DOCUMENTS 6,061,023 A * 5/2000 Daniel et al. ..... 342/354
6,111,542 A * 8/2000 Day et al. ..... 342/359
6,184,827 B1 * 2/2001 Dendy et al. ..... 342/372
6,400,315 B1 * 6/2002 Adler et al. ..... 342/359
6,825,807 B1 * 11/2004 McKinnon ..... 342/359
7,068,616 B2 6/2006 Chang et al.
7,339,520 B2 3/2008 Chang et al.
2006/0033659 A1 * 2/2006 Strickland ..... 342/372
* cited by examiner

*Primary Examiner* — Thomas H Tarcza
*Assistant Examiner* — Fred H Mull
(74) *Attorney, Agent, or Firm* — Tope-McKay & Associates; Marcus Risso; Sylvia Dominguez

(57) ABSTRACT

This device combines multiple elements that function like a single smart antenna that performs both connectivity and spatial discrimination functions. The antenna functions in both receive and transmit modes. The apparatus utilizes commonly used components to distinguish and separate desired satellite signals from those signals of satellites in close directional proximity. Disclosed are six methods for optimizing reception of desired satellite signals performed either mechanically or electronically and also included is an optimization technique when data stream reception is ≦1 Gbps. The transmission apparatus uses many of the same components as the receiver antenna and additionally uses in-beam nulling to fine tune transmission.

40 Claims, 9 Drawing Sheets

SATELLITE GROUND TERMINAL INCORPORATING A SMART ANTENNA THAT REJECTS INTERFERENCE

BACKGROUND OF THE INVENTION (1) Field of Invention

The present invention relates to ground terminals or antennas that receive and send communication signals to geo-stationary satellites and, more particularly, to ground terminals with rejection capabilities for satellites in orbits that are close enough to the orbit of a desired satellite so as to cause interference.

(2) Description of Related Art

Satellite communication became possible in 1957 when Russia launched Sputnik, the first man-made satellite. The first active direct-link communications satellite, Telstar, a joint project of AT&T, Bell Labs, NASA, the British General Post Office, and the French National PTT (Post Office) was launched in 1962. The first geo-stationary satellite placed in orbit was Syncom 3, launched on Aug. 19, 1964. A satellite in a geostationary orbit appears to be in a fixed position to an Earth-based observer. A geostationary satellite revolves around the Earth at a constant speed once per day over the equator and is considered to be in a geo-synchronous orbit. The orbiting satellites so situated are considered to be part of the geo-satellite belt and for consistency are referred to herein as geo-satellites.

Satellites in the geo-stationary orbit are particularly appealing because from the perspective of a viewer, the satellite appears to be stationary. This popularity has resulted in a glut of satellites vying for an ever decreasing number of available slots in the arc of the geo-stationary orbit. As the geo-stationary orbit becomes more crowded, the need for an antenna system that can discern the signal from a desired satellite to the exclusion of those in nearby orbital slots is becoming increasingly acute. Fulfilling this need without requiring extensive and expensive large reflectors and fine-tuning in aiming is an important goal.

Through voluntary national and international agreements, geo-satellites are spaced a few degrees apart in geostationary orbits to assure minimal interference between satellites in close orbital proximity. However, as the demand from business, consumers, and governments increases, satellites are allocated over the close-by slots servicing different coverage areas for both C and Ku band applications. Coordination between service providers with satellites in nearby orbital slots, which service satellites in closely-spaced coverage areas using the same spectrum, is a technological challenge because of interference between the signals of the satellites in close directional proximity to each other. There are solutions to resolve these interference issues using both space-based and ground-based approaches.

SUMMARY OF INVENTION

This invention utilizes a combination of commonly used components to distinguish and separate desired satellite signals from those signals of neighboring satellites in close proximity. The device combines multiple elements that function like a single smart antenna that performs both connectivity and spatial discrimination functions and operates in both receive and transmit modes. Additionally the invention includes six methods for optimizing reception of desired satellite signals, performed mechanically or electronically and also specifies an optimization technique when data stream reception is ≦1 Gbps using processing techniques within the state-of-art technology envelope at both C and Ku bands.

This invention takes received signals from geo-satellites and sends the signals through a receiver system. The receiver system is comprised of a plurality of directional receiver elements that are aimed in the general direction of a target satellite. The signals are then communicated to a controller module that is comprised of an optimization module configured to receive signals from geo-satellites through the receiver elements. Based on parameters of the signals and on user input criteria, adjustments are made to the signal parameters to meet the user input criteria. The adjusted signal parameters result in improved reception of a target satellite signal and reduced reception of undesired signals from extraneous satellites.

The directional receiver elements of the receiver system have adjustable element parameters which, when adjusted, modify the signal parameters. This invention also claims the receiver system, comprising adjustable element parameters via mechanically-adjustable receiver element spacing. The optimization module of the receiver system iteratively modifies the adjustable element parameters by gradient search principles based on user input criteria until the signal parameters meet the user input criteria.

This invention also teaches a receiver system, wherein the signal parameters include amplitude and phase. The controller module adjusts at least one of the element parameters and the signal parameters, utilizing an optimization technique selected from a group consisting of: 1) receiver element spacing perturbation; 2) radio-frequency element weighting, wherein the element weighting is accomplished by RF amplitude and phase adjustment of the signals, resulting in weighted received signals, that coherently sum the weighted received signals; 3) baseband element analogue weighting technique; and 4) digital beamforming (DBF). This invention additionally discloses that the directional receiver elements of the receiver system are configured in a manner consistent with fixed locations, re-locatable positions, or mobile positions.

A baseband element analog weighting technique may feature analogue I/Q circuitry to enable adjustment in the in-phase and quadrature components of the signals of interest. DBF can be utilized for both narrowband and broadband nulling applications. Broadband nulling processing can be implemented via finite impulse response (FIR) filtering techniques or simple amplitude and phase weighting but with multiple elements for a single constraint.

Amplitude and phase are included as signal parameters of the receiver system. Through a signal processor, the controller module adjusts the signal parameters only, in this disclosed technique utilizing one of the following optimization techniques: 1) radio-frequency element weighting, wherein the element weighting is accomplished by RF amplitude and phase adjustment of the signals, resulting in weighted received signals, and coherently summing the weighted received signals; 2) baseband element analog weighting technique; and 3) DBF.

Also taught in this invention is a receiver optimization apparatus for receiving signals from geo-satellites. The apparatus comprises a controller module for receiving a satellite signal, having signal parameters, from a set of directional receiver elements. The controller module includes an optimization sub-module configured to receive the satellite signal, and based on signal parameters of the received satellite signal and on user input criteria; an adjustment of the signal parameters is made to meet the user input criteria. This technique results in improved reception of a target satellite signal and reduced reception of undesired signals from extraneous satellites. Additionally, based on the signal parameters, the controller module is configured to provide adjustment information for adjusting element parameters for the set of directional receiver elements. This invention also discloses that the optimization sub-module iteratively adjusts the adjustable element parameters using gradient search principles based on the user input criteria until the signal parameters meet the user input criteria.

This invention teaches an apparatus that receives a geo-satellite signal with signal parameters that include amplitude and phase, and where the controller module adjusts at least one of the element parameters and the signal parameters. This technique also utilizes an optimization technique selected from a group consisting of: 1) receiver element spacing perturbation; 2) radio-frequency element weighting, wherein the element weighting is accomplished by RF amplitude and phase adjustment of the signals, resulting in weighted received signals, and coherently summing the weighted received signals; 3) baseband element analog weighting technique; 4) and DBF. This invention also discloses arranging the apparatus so that each directional receiver element is configured so that the directional receiver elements are in fixed locations, re-locatable positions, or mobile positions with respect to each other.

This invention also teaches an apparatus that detects signal parameters of geo-satellites where such signals include amplitude and phase. The controller module adjusts the signal parameters only utilizing an optimization technique selected from a group consisting of: 1) radio-frequency element weighting, wherein the element weighting is accomplished by RF amplitude and phase adjustment of the signals, resulting in weighted received signals, and coherently summing the weighted received signals; 2) baseband element analog weighting technique; and 3) DBF.

Also taught in this invention is the use of the reflector array in transmit mode.

A method for optimizing reception of signals from geo-satellites is taught in this invention. This method comprises acts of: receiving a satellite signal, having signal parameters, from a set of directional receiver elements; based on signal parameters of the received satellite signal and on user input criteria. Then the method teaches adjusting the signal parameters to meet the user input criteria and that results in improved reception of a target satellite signal and reduced reception of undesired signals from extraneous satellites. Also disclosed for this method is a technique where the signal parameters include amplitude and phase and where in the act of adjusting the signal parameters, at least one of the element parameters and the signal parameters is adjusted utilizing an optimization technique. The optimization technique is selected from a group consisting of: 1) receiver element spacing perturbation; 2) radio-frequency element weighting, wherein the element weighting is accomplished by RF amplitude and phase adjustment of the signals, resulting in weighted received signals, and coherently summing the weighted received signals; 3) baseband element analog weighting technique; and 4) DBF. Additionally this method discloses optimizing signals from geo-satellites further comprising an act of providing adjustment information based on the signal parameters for adjusting element parameters of the set of directional receiver elements. This method also teaches optimizing signals from geo-satellites, where in the act of adjusting the signal parameters, the adjustable element parameters are adjusted by gradient search principles based on the user input criteria until the signal parameters meet the user input criteria. Further described in this method in which the signal parameters include amplitude and phase, where in the act of adjusting the signal parameters, at least one of the element parameters and the signal parameters is adjusted utilizing an optimization technique. That optimization technique is again selected from a group consisting of: 1) receiver element spacing perturbation; 2) radio-frequency element weighting, wherein the element weighting is accomplished by RF amplitude and phase adjustment of the signals, resulting in weighted received signals, and coherently summing the weighted received signals; 3) baseband element analog weighting technique; and 4) DBF.

A computer program product for optimizing reception of signals from geo-satellites is also disclosed in this invention. The computer program product comprising computer-readable instructions stored on a computer-readable media for causing a signal processing system to perform acts comprising: receiving a satellite signal that has signal parameters, from a set of directional receiver elements; based on signal parameters of the received satellite signal and on user input criteria, the signal parameters are adjusted to meet the user input criteria, resulting in improved reception of a target satellite signal and reduced reception of undesired signals from extraneous satellites.

The disclosed computer program product further comprises computer-readable instructions on the computer-readable media for causing the data processing system to perform an act of providing adjustment information based on the signal parameters for adjusting element parameters of the set of directional receiver elements. This invention teaches that the computer program product also in the act of adjusting the signal parameters, the adjustable element parameters are adjusted by gradient search principles based on the user input criteria until the signal parameters meet the user input criteria.

Also disclosed in this invention is that the computer program product adjusts the signal parameters and the signal parameters include amplitude and phase. In the act of adjusting the signal parameters, at least one of the element parameters and the signal parameters is adjusted utilizing an optimization technique selected from a group consisting of: 1) receiver element spacing perturbation; 2) radio-frequency element weighting, wherein the element weighting is accomplished by RF amplitude and phase adjustment of the signals, resulting in weighted received signals, and coherently summing the weighted received signals; 3) baseband element analog weighting technique; and 4) DBF.

The computer program product as disclosed in this invention adjusts the signal parameters and the signal parameters include amplitude and phase. In the act of adjusting the signal parameters, at least one of the element parameters and the signal parameters is adjusted utilizing an optimization technique selected from a group consisting of: 1) receiver element spacing perturbation; 2) radio-frequency element weighting, wherein the element weighting is accomplished by RF amplitude and phase adjustment of the signals, resulting in weighted received signals, and coherently summing the weighted received signals; 3) baseband element analog weighting technique; and 4) DBF.

BRIEF DESCRIPTION OF THE DRAWINGS

The objects, features, and advantages of the present invention will be apparent from the following detailed descriptions of the various aspects of the invention in conjunction with reference to the following drawings, where.

DETAILED DESCRIPTION

Figure 1:
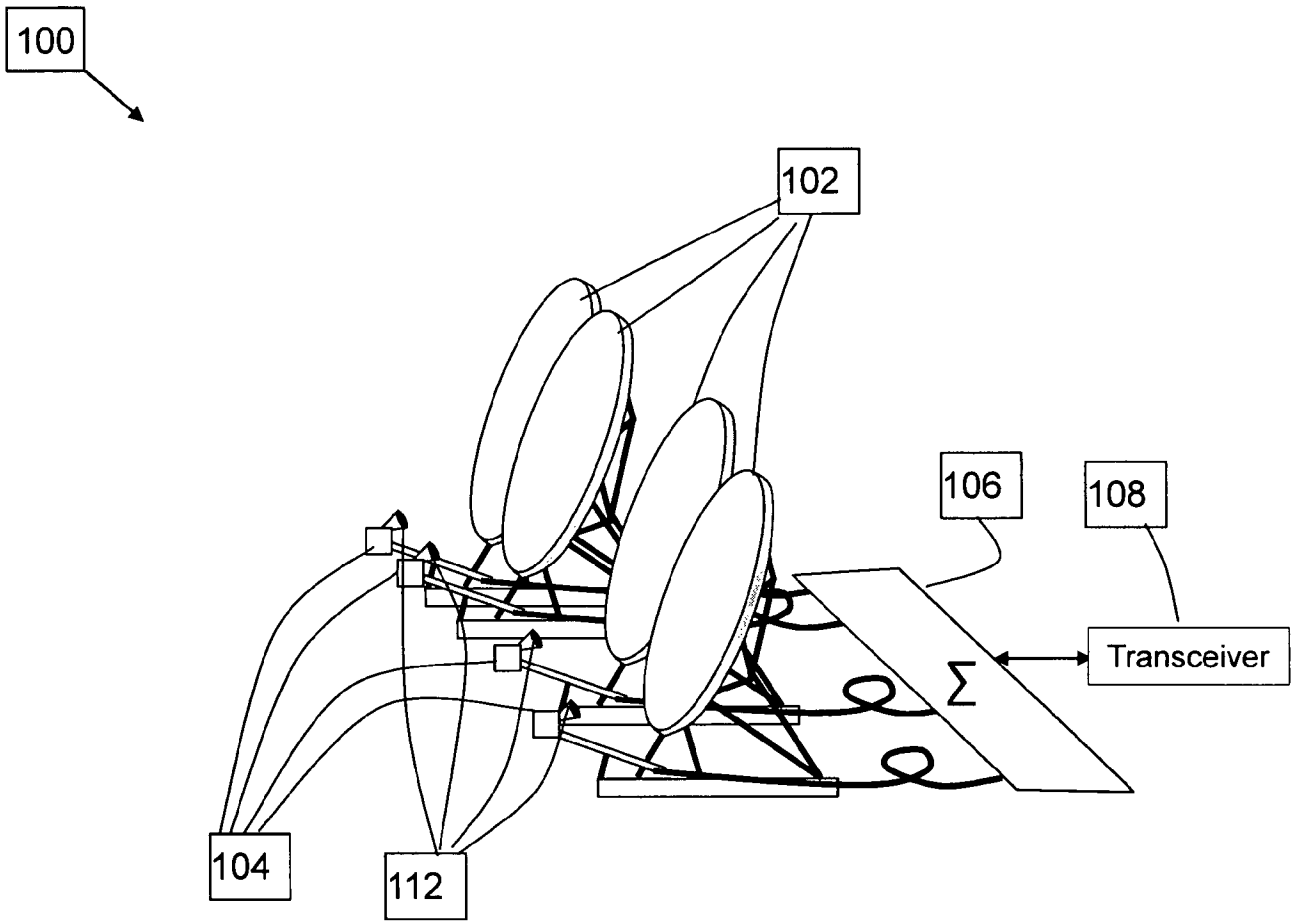
FIG. 1 is a block diagram of a four-element antenna array in receive mode.

The following description is presented to enable one of ordinary skill in the art to make and use the invention and to incorporate it in the context of particular applications. In the description provided below, numerous specific details are set forth in order to provide a more thorough understanding of the present invention. In other instances, well-known structures and devices are shown in block diagram form, rather than in detail, in order to avoid obscuring the present invention. Additionally, various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

Before describing the invention in detail, a description of various principal aspects of the present invention is provided. Next, an introduction is provided to provide the reader with a general understanding of the present invention. Finally, a description of the specific details of the present invention is provided to give an understanding of the specific details.

(1) Principal Aspects

The present invention has three "principal" aspects. The first is a ground terminal for satellite communications. In addition to the hardware listed below, the ground terminal also includes a signal processing system that is typically in the form of a computer system operating software or in the form of a "hard-coded" instruction set. This system may be incorporated into a wide variety of devices that provide different functionalities. The second principal aspect is a method, typically in the form of software, operated using a signal processing system (computer). The third principal aspect is a computer program product. The computer program product generally represents computer-readable instruction means stored on a computer-readable medium such as an optical storage device, e.g., a compact disc (CD) or digital versatile disc (DVD), or a magnetic storage device such as a floppy disk or magnetic tape. Other, non-limiting examples of computer-readable media include hard disks, read-only memory (ROM), and flash-type memories. For clarity, each of these aspects will be described in more detail below.

(2) Introduction

The present invention relates to ground terminals with rejection capability that discriminates against close-in satellite interference. A close-in satellite refers to a satellite that from the perspective of a viewer or receiving antenna array is within approximately 2 degrees from a desired satellite such that it is so close as to interfere with reception of the desired signal. As noted above, geo-satellites are spaced a few degrees apart in geostationary orbits to assure a minimum interference to and from nearby satellites. However, as the demand from business, consumers and governments increases, satellites are allocated over the close-by slots to service different coverage areas for both C and Ku band applications. Coordination among service providers at nearby orbital slots, servicing different and closely spaced coverage areas using the same spectrum, becomes very difficult. The difficulty exists because of interference between the signals of the satellites in close proximity to each other.

FIG. 1 is a block diagram of a typical four element array in receive mode as disclosed in this invention. The present invention provides a solution to resolve the interference issues by utilizing mechanical and electronic optimization approaches. These approaches reject interference by using a plurality of reflector elements 102, their connected radio-frequency (RF) front ends 104, including a horn feed 108, and a unique combining mechanism 106 to distinguish and select the signal of a desired satellite from the interference signals of satellites in close proximity at the same frequency spectrum. Further details are provided below.

(3) Specific Details of the Present Invention

As described above, the present invention teaches a ground terminal 100 for satellite communications that rejects interference from extraneous satellites. Generally, the ground terminal 100 is configured to both receive and transmit signals to and from orbital satellites. For clarity, the receive functions will be described first, with the transmit functions presented thereafter. Additionally, digital implementations are also presented to provide the reader with specific, yet non-limiting examples of applications of the present invention.

(3.1) Receive Functions

FIG. 1 is a block diagram of a four element antenna array 100 in receive mode, which consists of a plurality of receive reflector elements 102 with their associated horn feeds 112, an equal number of RF front ends 104, and a dedicated RF combining network 106. Each reflector is connected to a RF front-end 104, comprising a low noise amplifier (LNA) 420, band pass filter (BPF) 404, and an optional frequency down converter 420.

The total surface area of the apertures of the four separated reflectors 102 dictates the high gain the antenna array 100 can deliver. The aperture of a reflector is defined as the projected area of the reflector that is exposed to the satellite signal. The physical baseline measured in wavelengths establishes the angular resolution capability of the antenna array 100.

Each individual reflector 102 is oriented toward the targeted satellite. The array is aligned in an east-west direction, providing the maximum angular resolution capability along the geo-synchronization arc centered at the target satellite. The spacing between each reflector 102 is calculated utilizing an optimization program to maintain a maximum gain level in the direction of the desired satellite, while generating a null in the direction of a nearby satellite to and from which the receiver system would ordinarily suffer interference.

The baseline is the distance between the two outermost edges of the reflector 102 apertures, and is chosen to provide adequate angular resolution. The antenna array angular resolution shall be smaller than the satellite angular separation viewed by the ground station. A simple rule of thumb used to derive a minimum baseline for a given angular resolution is:

$$L/\lambda=60\delta, \text{ where}$$

L=length of a minimum baseline,

δ=angular resolution of the array antenna in degrees,

λ=wavelength.

The receive array 100 is "optimized" to receive the desired signals and reject interference signals either mechanically or electronically, and the optimization processing can be performed non-real time. For the geometry of relatively stationary satellites, an optimized array 100 may be static, and for slowly-time-varying satellite locations it is often dynamic. The reflector elements 102 of the antenna 100 may be mounted in any suitable manner, non-limiting examples of which include on a platform, on separate tripods, another structure situated directly on the ground or mounted on a movable object non-limiting examples being a truck, train, ship or plane.

There are six applicable optimization techniques as described below. In each of the following examples a four element reflector array is used and for reflector location, X=0 is boresight. The directional elements may be an element that is not a reflector, nor are all the elements necessarily identical. These examples are intended to simplify the illustrations and do not indicate that there is any limitation on the number of directional elements.

(A) Optimizations Via Element Spacing Variation.

At a given baseline, there is more than one solution attainable by adjusting the spacing among the reflectors 102. The optimized spacing may be aperiodic, and random. The (initial) separations may be based upon a minimum redundancy array (MRA) principle. The coherent summation of the four elements constitutes the optimized array output, which features the directional discrimination capability of maintaining a high gain level in the direction of the desired satellite while generating a null in the directions of close proximity satellites to and from which the receive array 100 would have interference.

Figure 2:
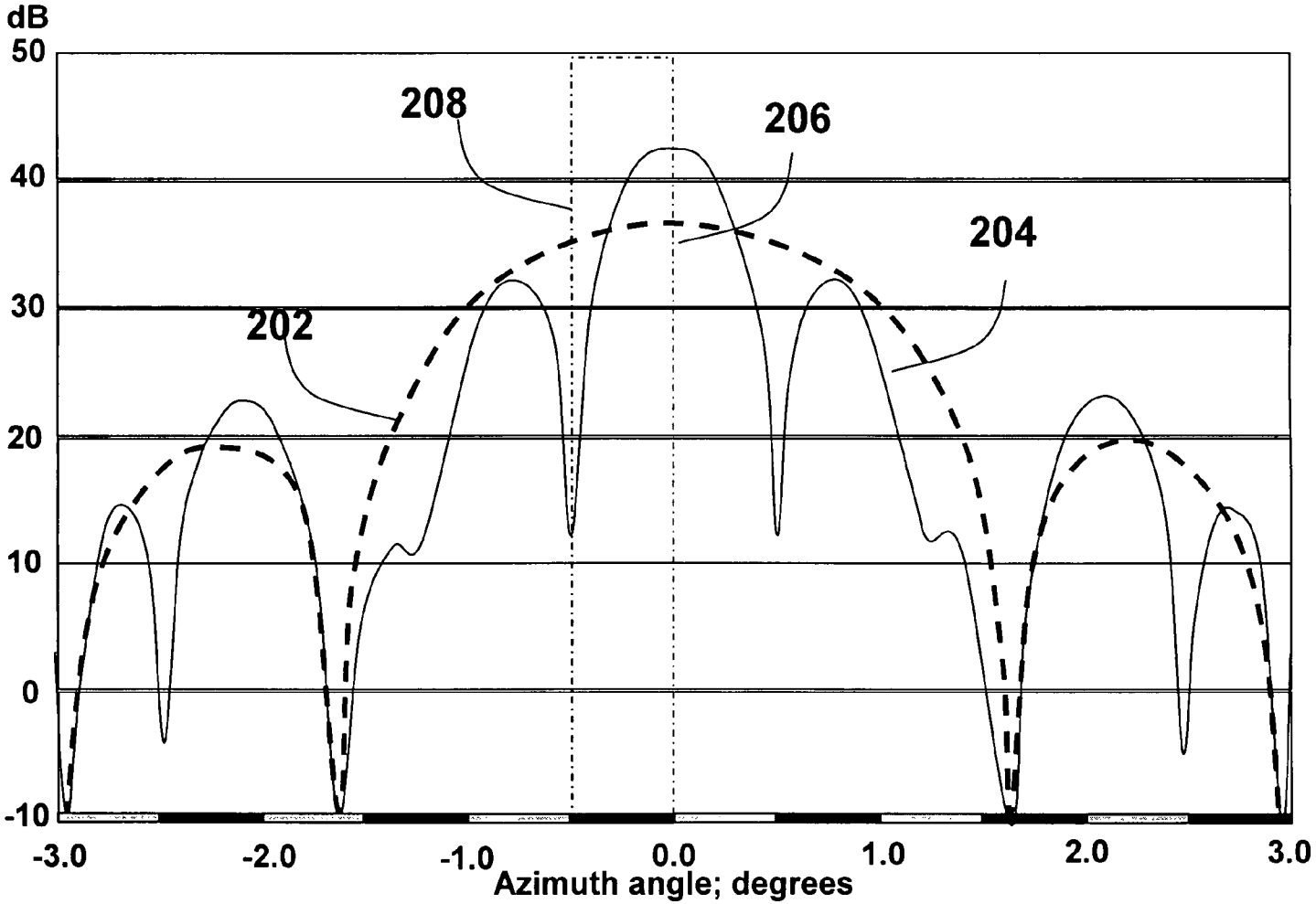
FIG. 2 is a graph of the calculated azimuth receive pattern of a reflector element over an azimuth range covering ±3° shown as a dashed line, the calculated receive pattern of a reflector of an antenna array optimized by spacing perturbation shown as a solid line and both the desired and the potential interference source azimuths indicated by thin dashed vertical lines.

FIG. 2 is a graphic representation that depicts the calculated azimuth receive pattern of a reflector element shown as a dashed line 202 over an azimuth range covering ±3°, and that of the optimized array by spacing perturbation shown as a solid line 204. The vertical scale on the chart is in decibels (dB) and the horizontal scale is in degrees of azimuth. The desired receive direction is at mechanical boresite (azimuth angle=0°) 206. The potential interfering satellite is at −0.5° direction (azimuth angle) 208, separated from the desired signal by only a small fraction of a width of the element beam. Both the desired 206 and the potential 208 interference source directions are indicated by dashed vertical lines.

The array baseline is 80λ long, or about 6 meters at 4 GHz. The element peak gain is approximately 34 dBi. It is clear that mechanical spacing perturbation optimization processing enables the four-reflector array 102 to maintain ~40 dB directional gain in the desired signal direction and simultaneously provides a 30 dB directional discrimination capability to an errant signal that is only separated by 0.5° from the desired signal.

Figure 4A:
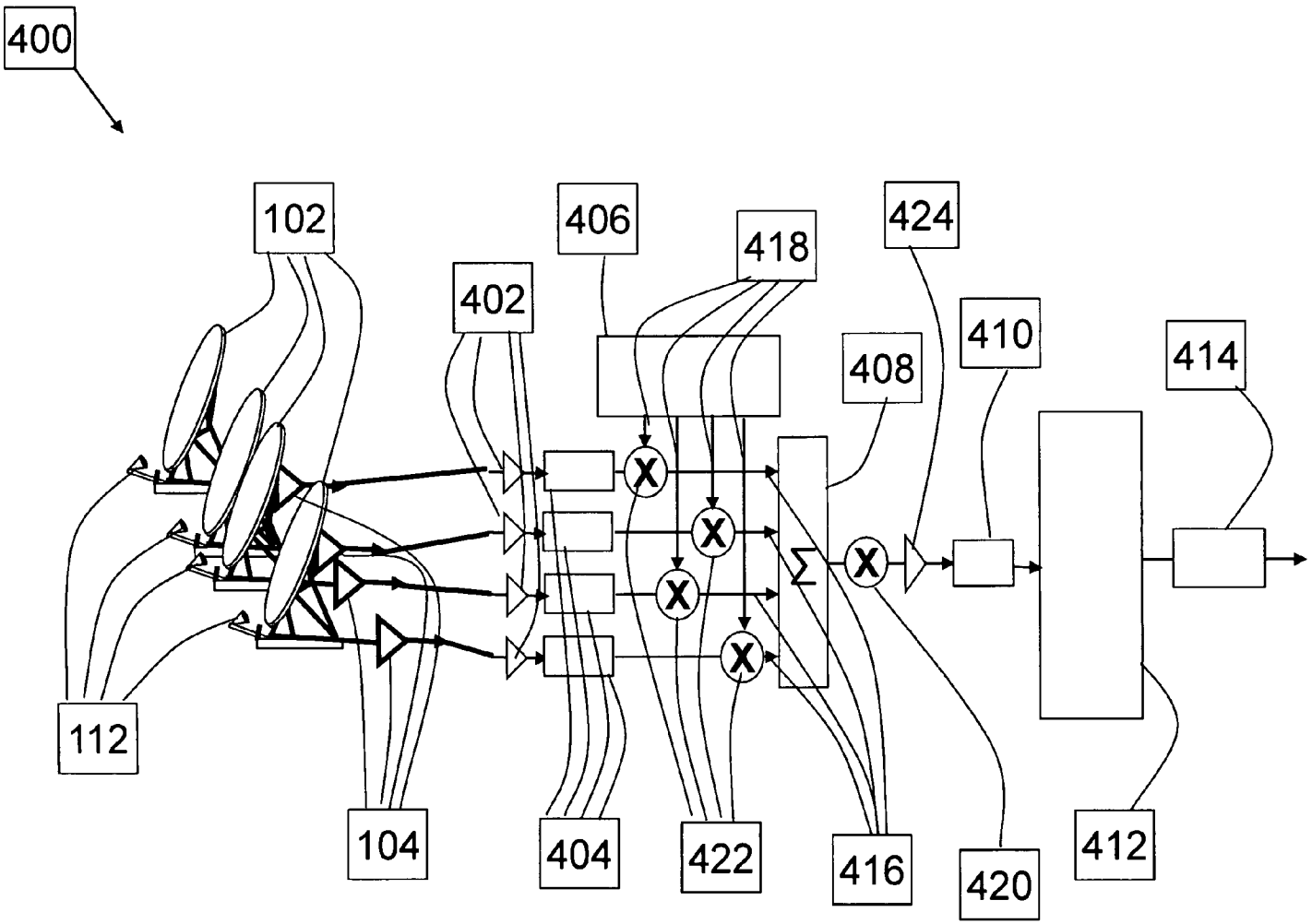
FIG. 4A is a simplified block diagram illustrating the antenna array structure required to perform receiving (RX) digital beam forming (DBF) techniques for utilizing directional optimization processing.

The original locations for the four reflector elements 102 were at X=0, 20λ, 60λ, and 80λ, respectively. The step size uncertainty for reflector 102 spacing is set at 0.1λ. The resulting optimized positions for the reflectors 102 are at X=0, 24.5λ, 60λ, and 80λ, respectively. Multiple element spacing perturbation techniques can be constrainted to maintain the same null directions for the same array antenna 100 operated at both transmit and receive frequency bands (B) Optimizations Via RF Element Weighting FIG. 4A For a given geometry, solutions may be found by adjusting the relative RF amplitudes and phases of signals received by various reflectors 102 resulting in weighted signals. The weighted signals are coherently summed to provide the optimized array output, which features a directional discrimination capability by maintaining a maximum gain level in the desired satellite direction, while generating a null at the direction of a close proximity satellite to and from which the user terminal would have interference.

Figures 3A, 3B:
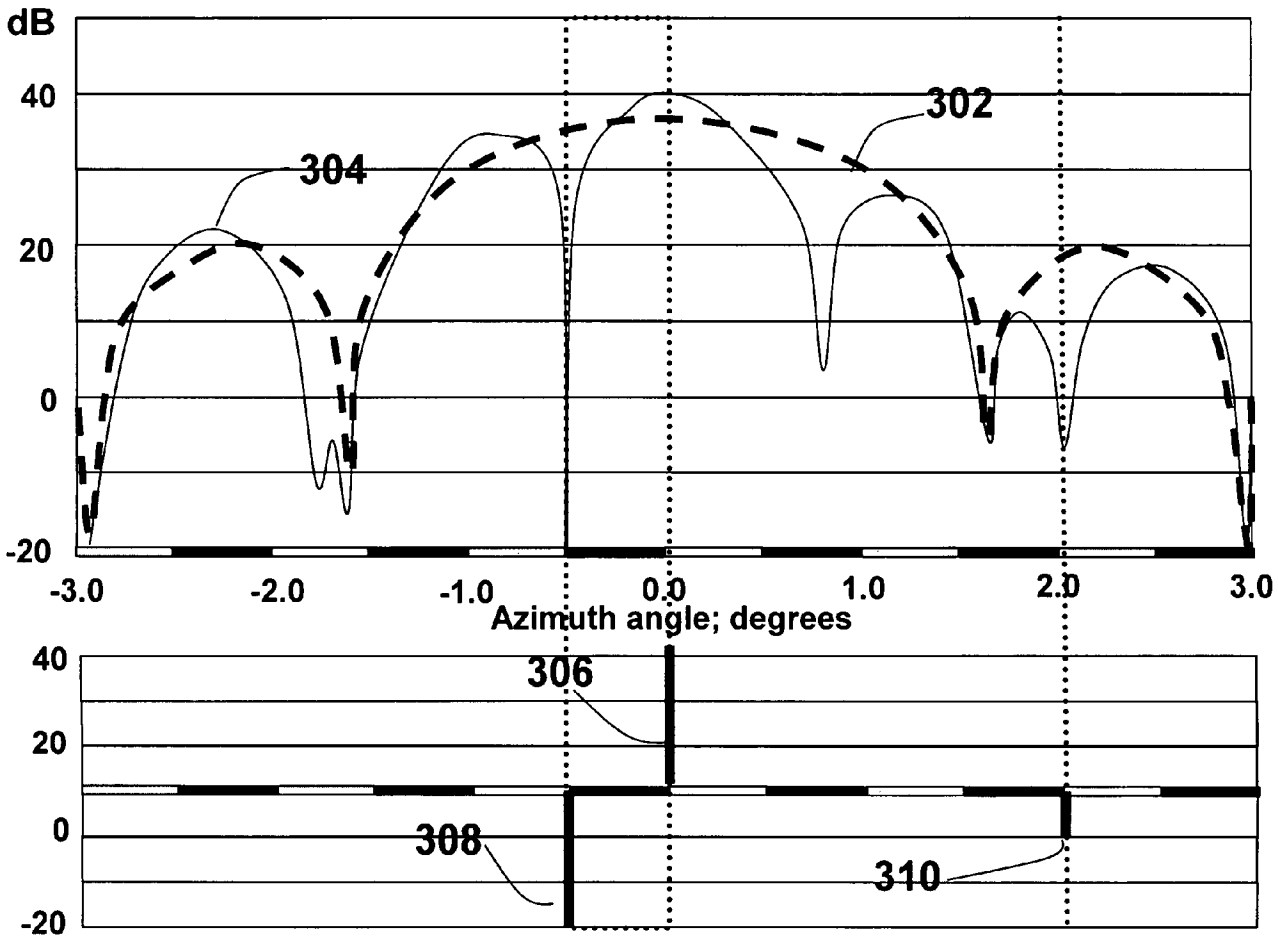
FIG. 3*a* (upper) is a graph of an array pattern optimization via amplitude and phase weighting among the four reflector elements.
FIG. 3*b* (lower) is a graph indicating the deflection of the signal at azimuths matching the target and interfering satellite locations.

FIG. 3*a* (upper) depicts simulated results using the same array discussed above, but using electronic weighting instead of spacing perturbation for signal optimization. There are three directional constraints instead of two as indicated in FIG. 2. Shown are the original signal (as a dashed line) 302 and the optimized signal (as a solid line) 304. The vertical scale is in decibels (dB) and the horizontal scale again is in degrees of azimuth. As indicated in FIG. 3*b* (lower) in the bottom panel, the desired direction is at boresite 306. At −0.5° (azimuth angle) 308, and 2.0° 310, it is desirable to have the directional response of the antenna gain below approximately −30 dBi and approximately −10 dBi, respectively. In this panel, the vertical scale is in dBi and the horizontal scale, as in FIG. 3*a* above, is in degrees of azimuth. Again, the array baseline is 80λ long, or 6 meters at 4 GHz. The element peak gain is about 34 dBi. The four reflector array 102 was located at X=0, 20λ, 60λ, and 80λ, respectively. The weighting features in-phase (I) and quadrature (Q) programmable circuitries, performing amplitude adjustment on both I and Q in the optimization processing.

The calculated radiation pattern depicted on the top panel (FIG. 3*a*) clearly indicates that the electronic amplitude and phase optimization processing has enabled the reflector array to provide an optimized antenna radiation pattern with:

1) a ~40 dB gain for the desired signal direction,
2) a 60 dB directional discrimination capability to the potential interference at −0.5° direction, and
3) a 40 dB directional discrimination capability to the potential interference at 2.0° direction. The discrimination capability refers to rejection of an aberrant signal with respect to the desired signal direction.

(C) Optimizations Via Element Phased-Only Weighting

For a given array geometry, many solutions may be found by adjusting only the relative phases between signals received by various reflectors 102. The weighted signals are coherently summed to provide the optimized array 100 output, which features directional discrimination capability by maintaining a high gain level in the desired satellite direction, while generating a null at the direction of a nearby satellite to and from which the user terminal would have interference.

(D) Optimizations Via Combinations of (A) and (B), or (A) and (C)

For a given array, there are many solutions that can be found by perturbing the relative spacing between the reflectors 102 and adjusting the relative amplitudes and phases among signals received by various reflectors 102. The weighted signals produced by the reflector elements 102 with perturbed element spacing are coherently summed to provide the optimized array 100 output, which features a directional discrimination capability of maintaining a high gain level in the desired satellite direction, while generating a null at the direction of a nearby satellite to and from which the user terminal would have interference. For example, it is desirable to use (A) for transmit function, and (B) or (C) for receive function of a ground terminal 100.

(E) Optimizations Via Application of Broadband Nulling

Broadband nulling can be implemented in DBF through the application of the finite impulse response (FIR) technique. Additionally when there are large numbers of elements 102, techniques of utilizing a cluster of closely spaced multiple nulls centered at the interference direction via element amplitude and phase weighting only can also provide alternate viable solutions.

The optional frequency up/down converters not only provide frequency conversion functions but also perform analog "phase trimming" as a technique for RF weighting. The element weighting can be implemented via local oscillator (LO) distribution network, which has independent variable phasing capability in the multiple LO outputs, as a part of the frequency down conversion process. The down converted signals will have not only the alternation in carrier frequency but also additional phase offsets.

(3.2) Transmit Functions

Figure 4B:
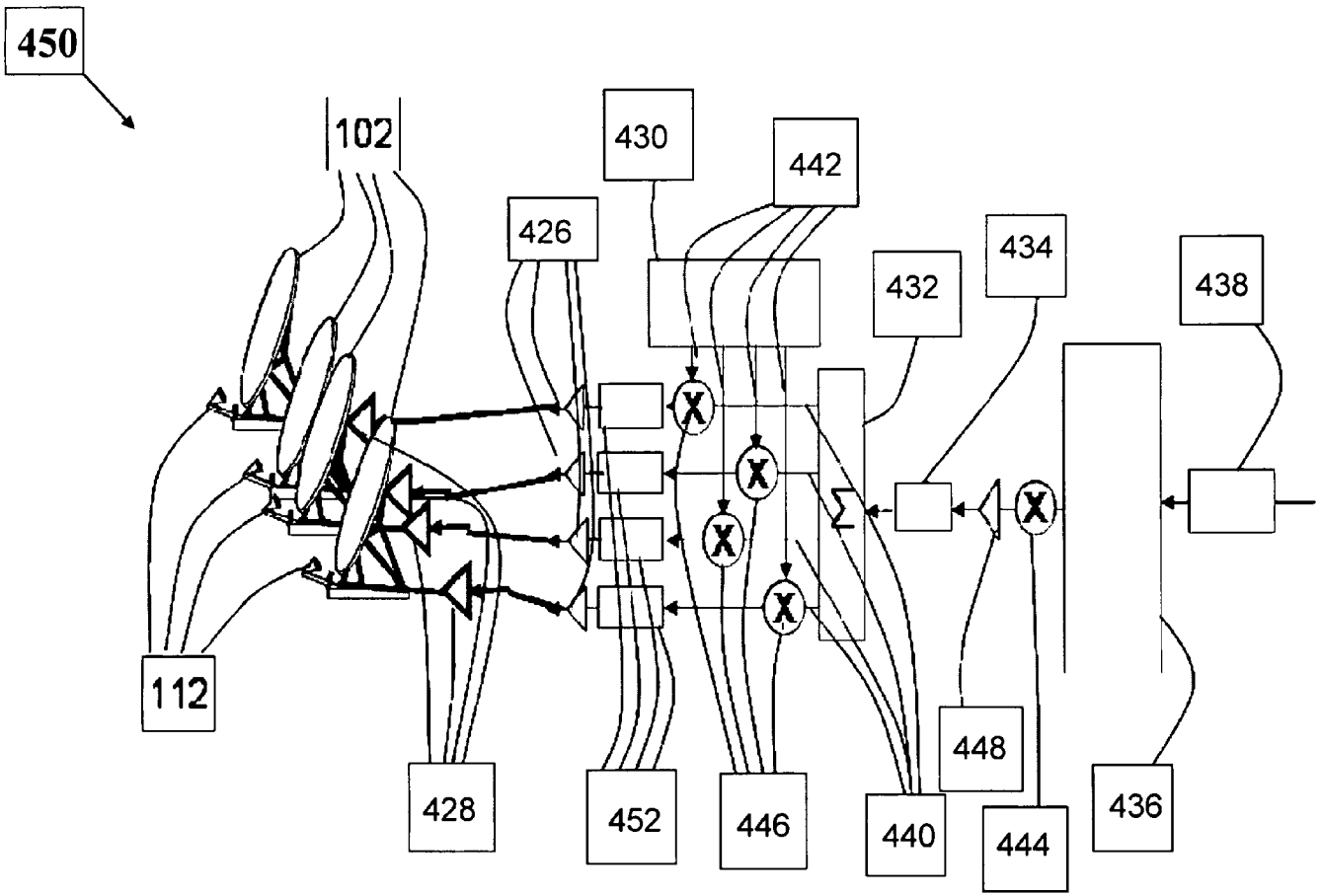
FIG. 4B is a simplified block diagram illustrating the antenna array structure required to perform transmit (Tx) digital beam forming (DBF) techniques for utilizing directional optimization processing.

Similarly, the multiple reflector arrangement can be used for transmit (Tx) array functions. This architecture is depicted in FIG. 4B 450 and is nearly identical to FIG. 4A, except the RF receiver frontends are replaced by RF frontends 112 with TX functionality. In the TX function, signals flow from baseband to RF.

Output of a digital transmitter 438 in baseband digital stream format is repeated into four separate channels, first to the TX DBF processor 436. In the DBF processor 436, the signals are then weighted by the beam forming vector (BWV), sample by sample continuously. The four weighted signal streams are code-division-multiplexed (CDM) digitally and then summed together before entering a digital to analog (D/A) converter which converts the signal to analog before exiting the DBF processor 436. The CDM signals are synchronized via orthogonally coded waveforms. The BWV beam controller (not shown) controls the TX beam-shaping via the controls of the (BWV) values.

Output of a digital transmitter 438 in baseband digital stream format is repeated into four separate channels, first to the TX DBF processor 436. In the DBF processor 436, the signals are then weighted by the beam forming vector (BMV), sample by sample continuously. The four weighted signal streams are code-division-multiplexed (CDM) digitally and then summed together before entering a digital to analog (D/A) converter which converts the signal to analog before exiting the DBF processor 436. The CDM signals are synchronized via orthogonally coded waveforms. The beam controller (not shown) controls the TX beam-shaping via the controls of the BMV values.

The output signals are frequency up-converted via a mixer 444 to the desired carrier frequency, amplified by a buffer amplifier 448, filtered by a band pass filter (BPF) 434, and then divided into four equal channels 440 via a 1:4 divider 432 for the weighted element signal recover.

Each is then synchronized and decoded via bi-phase modulators 446 in analog format. The 4 synchronized orthogonal codes 442 are generated by the code generator 430. The recovered weighted element signals are additionally filtered by band pass filters BPFs 452. Next, the recovered signals are amplified more by another set of amplifiers 426 before being sent to outdoor units.

The element signals are routed by cables (or other transmission means) and delivered to individual reflector elements 102. The individual output signals are power-amplified by the high power amplifiers (HPA) 428, and delivered to individual feeds 112. The 4 sets of radiated signals from the feed, reflected by the reflectors 102 are spatially combined in the far field. In the desired direction, the four output signals are combined nearly in-phase coherently. At each of the extraneous satellite directions, the 4 outputs are destructively combined together resulting in little signal intensity. Effectively, a beam peak is formed at the desired satellite direction, and nulls are moved toward the extraneous satellite directions.

A C-band HPA can be implemented either in the form of a solid state power amplifier (SSPA) or a traveling wave tube amplifier (TWTA).

The array's directional weighting vector for Tx functions, Tx beam weight vector (BWV), can be derived from the received BWV of the same array, due to the identical geometry of the elements and signal directions, and fixed ratios of Tx and receiver frequency bands. Those skilled in the RF and Antenna art can derive the BWV for Tx function based on values of the BWV for the receiver function of the same array, so that the array in Tx will feature a Tx radiation pattern with a beam peak at the desired direction and with nulls at the extraneous satellite directions. Therefore, only the receiver functions are used in the illustrations for this filing; the corresponding Tx functions will not be presented.

C-band ground terminals typically have 3° to 5° beamwidths in their main beams in receiver mode. When interferences from extraneous satellites appear at 0.5° to 2° from the desired satellite direction, those interferences are usually referred to as in-beam interferers. The ground terminal capability of nulling against the in-beam interferers is referred to as the in-beam nulling capability. In-beam nulling is feasible for both Tx and receive, when the terminals feature multiple high gain elements and long baselines in between.

(3.3) Digital Implementations

For ground terminals with a 1 Gbps or less signal reception data rate, the most cost effective method of implementing the directional optimization processing is through DBF techniques. FIG. 4 displays a non-limiting simplified block diagram of a DBF antenna array 400. The reflectors 102 collect and focus the satellite signals to the corresponding feeds individually. The four received signals, passing through 4 RF low loss connectors 104, will be amplified by low noise amplifiers 402 and filtered by band pass filters (BPFs) 404 independently. The four conditioned signals are modulated by a set of orthogonal codes 418 provided by a synchronous code generator 406, the signals then enter mixers that acts as bi-phase modulators 422, and then the modulated signals 416 are combined by a 4-to-1 combiner 408. The combined signals are frequency-down converted using a mixers 420, then pass through a buffer amplifier 424 and finally the signals are digitized by an analog to digital converter (A-2-D) 410, and sent to a DBF unit 412.

The DBF processing performs three functions; (1) de-multiplexing the coded signals and recovering the 4 element signals in digital representation individually, (2) element weighting and summing for beam forming and null steering, and (3) output signal re-formatting.

After the DBF processes, the processed signals are routed to a receiver 414. The receiver may be implemented in digital form and performs the standard digital receiving functions including synchronization, channelization, and demodulating functions. The demodulated signals are the 0's and 1's of the digital streams which will be decoded into information and data streams by follow-on devices.

For C-band terminals, it is possible to use direct sampling without frequency-down conversion to convert the C-band signals to baseband. In addition, the DBF processing 412 may use a single real-time operation sequence to perform both the decoding of element signals and element signal weighting of the beamforming processing in a single step. The received arrays 100 may be implemented adaptively to perform real-time optimization with additional built-in diagnostic circuits. Similarly the same implementation principles can be applied to use the DBF Array to transmit, which is not illustrated here.

Figure 5:
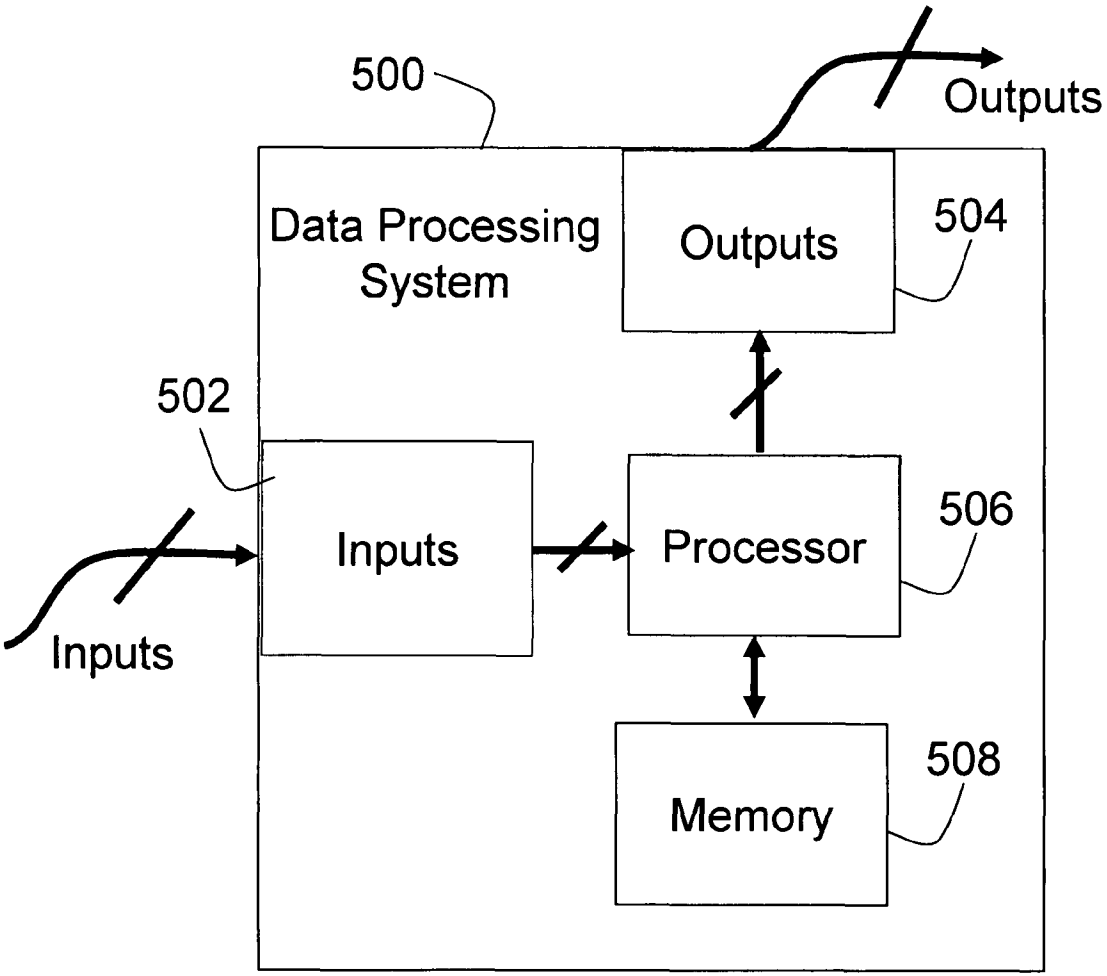
FIG. 5 is a block diagram illustrating components of a signal processing system according to the present invention.

In addition to the hardware listed above, the present invention also includes a signal processing system that is configured to perform the operations described herein. A block diagram depicting the components of a signal processing system 500 of the present invention is provided in FIG. 5. The data processing system 500 comprises an input 502 for receiving information. Note that the input 502 may include multiple "ports." Typically, multiple satellite signals are received and combined at each of the input ports. As a result of satellite locations and the antenna element geometries and locations, various inputs exhibit different phase and amplitude combinations of satellite signals. The process 506 will perform linear combination processing among the four input signals, and the processed signals are sent to the outputs 504. Usually there is parallel linear processing, generating multiple simultaneous outputs.

The processing may be iterative with a feed back loop, so that the final processed outputs are iteratively converged to the ones that meet the performance criteria set by users.

An output 504 is connected with another processor providing additional receiving functions, such as bit synchronization, channelization and other functions. The input 502 and the output 504 are both coupled with a main processor 506, which may be a general-purpose computer processor or a specialized processor designed specifically for use with the present invention.

The processor 506 is coupled with a memory 508 to permit storage of data, parameters of processing instructions, and operational software that are to be manipulated by commands to the processor 506.

Figure 6:
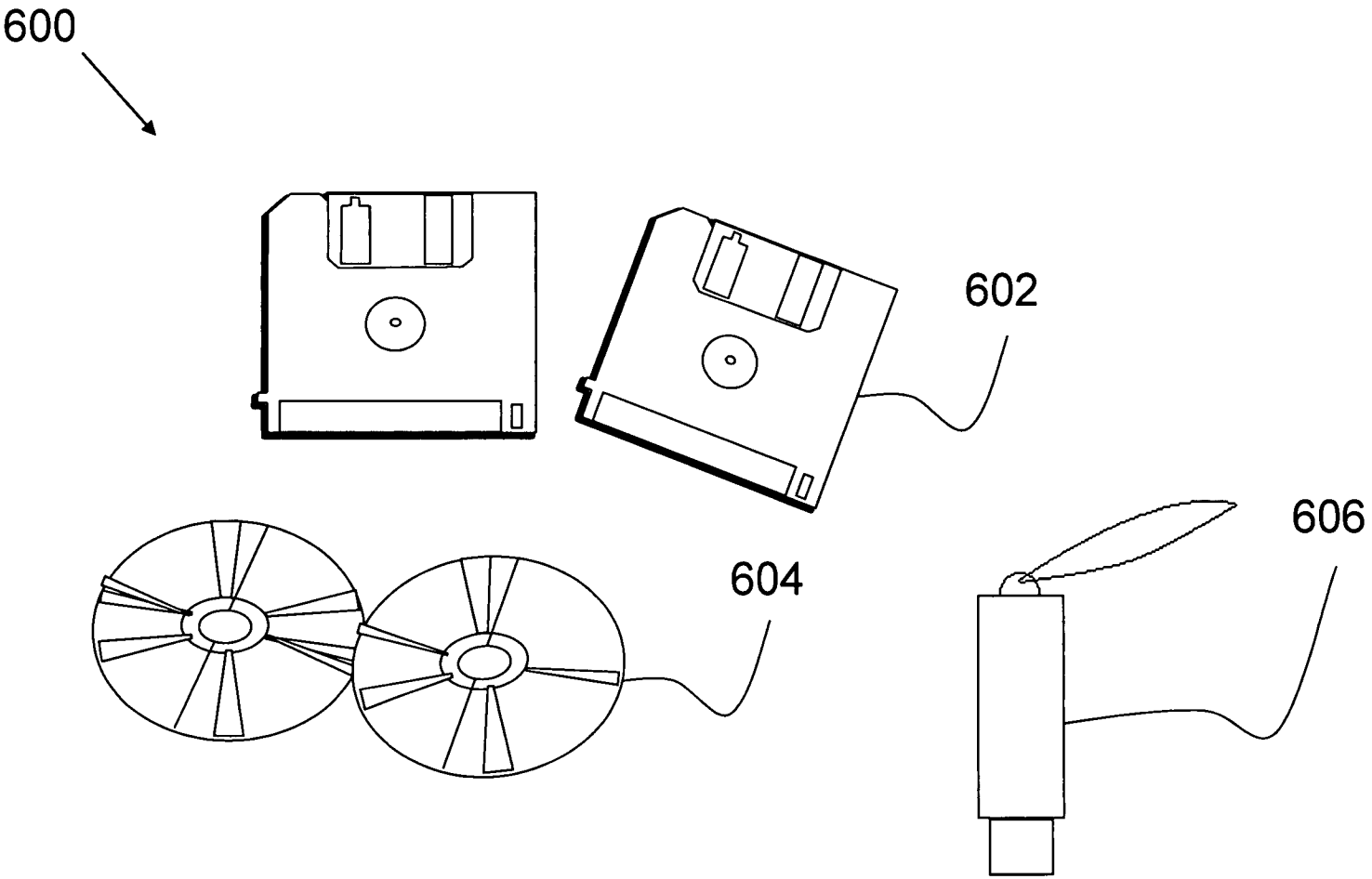
FIG. 6 is an illustration of a computer program product embodying the present invention.

Furthermore, the present invention also includes a computer program product that is formatted to cause a computer to perform the operations described herein. An illustrative diagram of a computer program product embodying the present invention is depicted in FIG. 6. The computer program product 600 is depicted as a floppy disk 602 or an optical disk such as a CD or DVD 604. However, as mentioned previously, the computer program product generally represents computer-readable instruction means stored on any compatible computer-readable medium. The term "instruction means" as used with respect to this invention generally indicates a set of operations to be performed on a computer, and may represent pieces of a whole program or individual, separable, software modules. The instruction means are executable by a computer to cause the computer to perform the operations. Non-limiting examples of "instruction means" include computer program code (source or object code) and "hard-coded" electronics (i.e. computer operations coded into a computer chip). The "instruction means" may be stored in the memory of a computer or on a computer-readable medium such as a floppy disk 602, a CD-ROM 604, and a flash drive 606.

Figure 7:
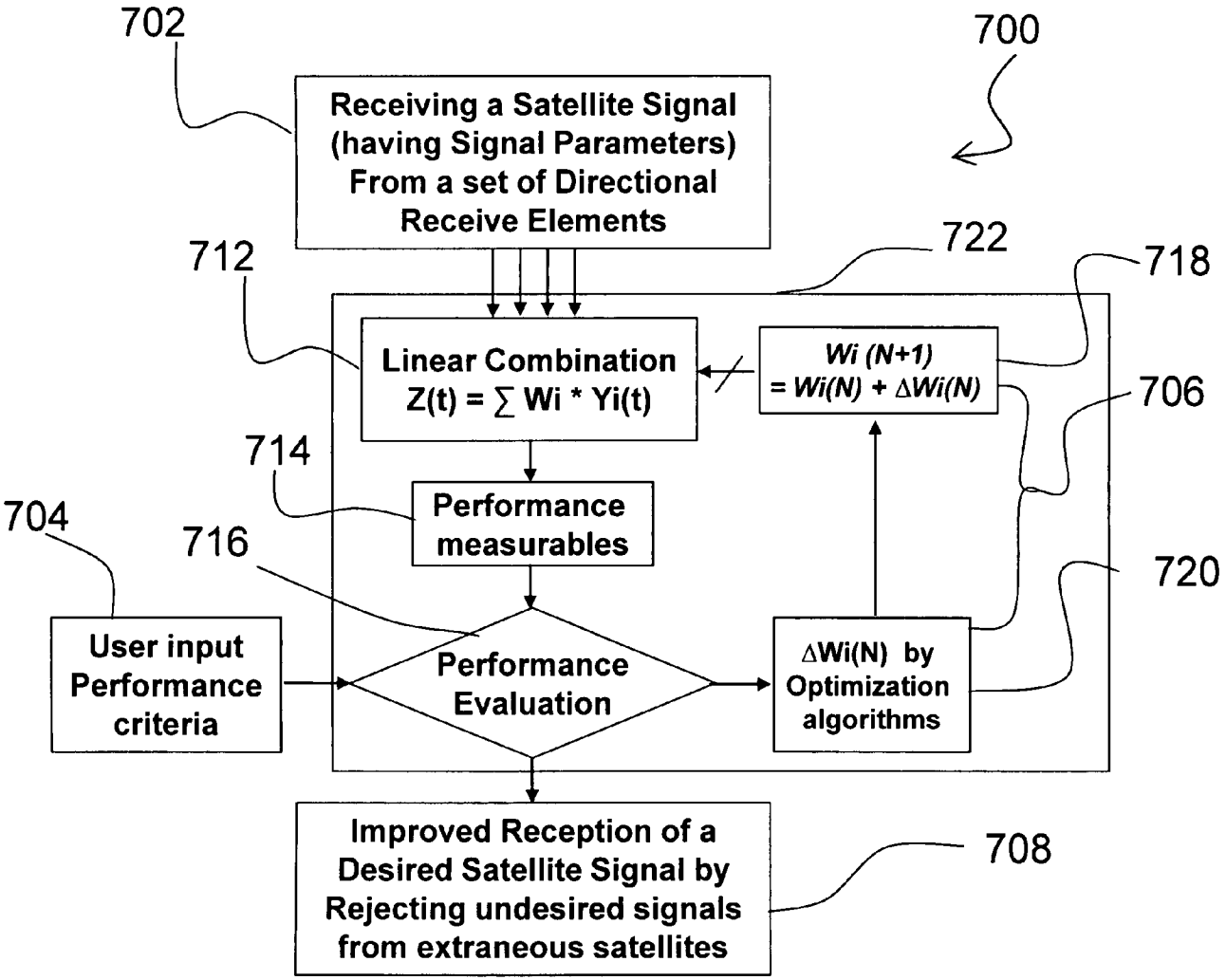
FIG. 7 is a flow chart illustrating a method for optimizing reception of signals from geo-satellites according to the present invention.

Furthermore, as illustrated in FIG. 7, the present invention also comprises a method 700 for optimizing reception of signals from geo-satellites. The method comprises a plurality of acts that result in improved reception of a desired satellite signal and reduced reception of undesired signals from extraneous satellites. For example and as depicted in FIG. 7, the method 700 includes an act of receiving a satellite signal 702 from a set of directional receiver elements. A linear combination process 712 within a controller module 722 is used to perform weighting and summing 706 of the four received signals based on the known satellite directional information or signal parameters and the summed results. This will be compared to the desired performance according to user input criteria 704. A measurement index of the difference between the measured performance and the desired performance is generated.

An iterative processing loop is utilized to include an act of adjusting 718 the signal parameters 706 and comparing process 716 to meet the desired performance based on the user input criteria 704. When the performance criteria are not met or equivalently the measurement index 714 is worse than desired, the updated weighting functions 720 of all elements will be generated based on gradient search principles, and goes to the linear combination process 712 again for a new iteration.

When the measurement index matches the desired one, the method 700 results 708 in improved reception of a target satellite signal and reduced reception of undesired signals from extraneous satellites. As can be appreciated by one skilled in the art, the method 700 also comprises additional acts that are preformed to achieve the operations and results provided above.

Figure 8:
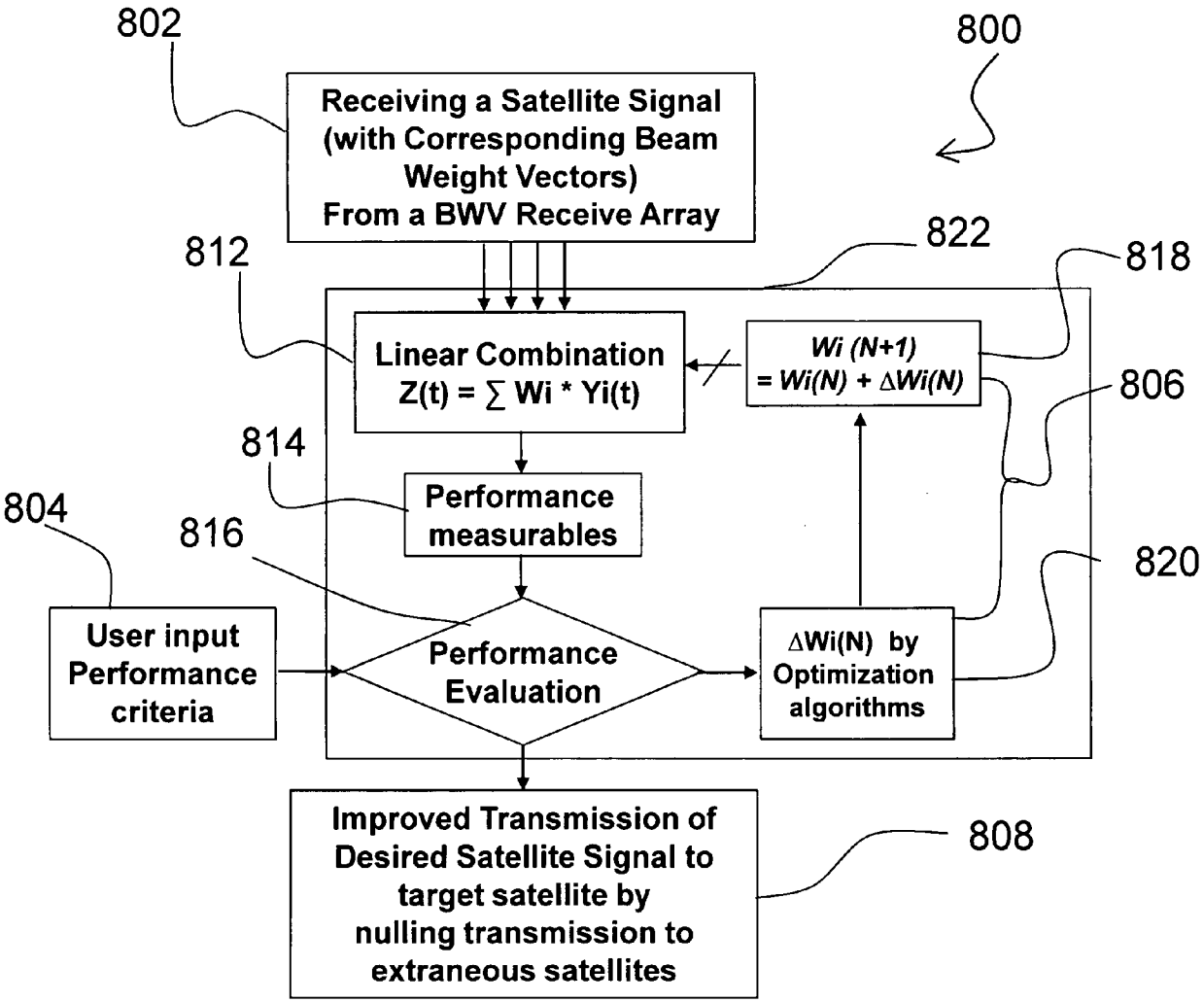
FIG. 8 is a flow chart illustrating a system for optimizing transmission of signals to target geo-satellites according to the present invention.

In addition, as illustrated in FIG. 8, the present invention also comprises a transmission system 800 for optimizing transmission of signals to geo-satellites. The system comprises a plurality of elements that improve the transmission of a desired satellite signal from a multiple reflector element array to a target satellite by producing a radiation pattern with a high gain beam peak directed toward the desired target satellite and nulls directed toward the direction of extraneous satellites. For example and as depicted in FIG. 8, the system 800 includes a receiving element for receiving a satellite signal 802 coupled with its corresponding beam weight vectors. A linear combination process 812 within a BWV controller module 822 is used to perform weighting and summing 806 of the four received signals based on the receive beam weight vector and the summed results. This will be compared to the desired performance according to user input criteria

804. A measurement index of the difference between the measured performance and the desired performance is generated.

An iterative processing loop is performed by an adjusting element 818 that adjusts the signal parameters 806 together with a comparing process 816 to meet the desired performance based on the user input criteria 804. When the performance criteria are not met or equivalently the measurement index 814 is worse than desired, the updated weighting functions 820 of all elements will be generated based on gradient search principles, and goes to the linear combination process 812 again for a new iteration. When the measurement index 814 matches the desired one, the system 800 results in producing a radiation pattern 808 with a high gain beam peak directed toward the desired target satellite and nulls directed toward the direction of extraneous satellites thus improving the transmission of a desired satellite signal to a target satellite by nulling the transmission of the desired satellite signal to extraneous satellites. For example, the user input criteria comprises: a user inputting the high gain beam peak at an angle A aimed at the target satellite, wherein with respect to the transmission system the target satellite is positioned at an orientation corresponding to the angle A; the user inputting a first null gain at an angle B; and the user inputting a second null gain at an angle C, wherein the angles A, B, and C are different from one another, whereby, with respect to the transmission system, a first extraneous satellite is positioned at an orientation corresponding to the angle B and a second extraneous satellite is positioned at an orientation corresponding to the angle C, without the extraneous satellites receiving interference from the satellite signal transmitted from the transmission system to the target satellite.

What is claimed is:

1. A transmission system for transmitting signals to geo-satellites, the transmission system comprising:

a plurality of directional transmitter elements for aiming in the general direction of a target satellite;

a controller module communicatively connected with the directional transmitter elements, the controller module including an optimization module configured to transmit a satellite signal to the geo-satellites through the transmitter elements, and based on signal parameters of a received satellite signal, estimated transmitted radiation patterns, and on user input criteria, causing an adjustment of the signal parameters to meet the user input criteria, resulting in improved transmission to the target satellite;

wherein the user input criteria is set to form a radiation pattern from a reflector-element array comprising a plurality of reflectors (multiple reflector array), with a high gain beam peak toward the target satellite direction, and nulls toward extraneous satellite directions, and wherein the user input criteria comprises: a user inputting the high gain beam peak at an angle A aimed at the target satellite, wherein with respect to the transmission system the target satellite is positioned at an orientation corresponding to the angle A; the user inputting a first null gain at an angle B; and the user inputting a second null gain at an angle C, wherein the angles A, B, and C are different from one another, whereby, with respect to the transmission system, a first extraneous satellite is positioned at an orientation corresponding to the angle B and a second extraneous satellite is positioned at an orientation corresponding to the angle C, without the extraneous satellites receiving interference from the satellite signal transmitted from the transmission system to the target satellite.

2. The transmission system for transmitting signals to geo-satellites as set forth in claim 1, including a beam weight vector (BWV) calculated for a receive array (the receive BWV), comprising:

a BWV controller module communicatively connected with the directional transmitter elements, the BWV controller module including an optimization module configured to transmit a satellite signal to the geo-satellites through the transmitter elements, and based on a receive beam weight vector, causing an adjustment of the transmit (Tx) signal parameters and resulting in improved transmission to a target satellite;

whereas a resulting Tx radiation pattern from the multiple reflector-element array features a high gain beam peak toward the desired satellite direction, and nulls toward the extraneous satellite directions.

3. The transmission system for transmitting signals to geo-satellites as set forth in claim 2, wherein the user inputs the high gain beam peak to be greater than 40 dB units at the angle A equal to zero degrees aimed at a first target satellite, the user inputs the first null gain to be less than −30 dB at the angle B equal to −0.5 degrees, and the user inputs the second null gain to be less than −10 dB at the angle C equal to 2 degrees, whereby, with respect to the transmission system, the first extraneous satellite is placed at an orientation corresponding to −0.5 degrees and the second extraneous satellite is placed at an orientation corresponding to 2 degrees, without the extraneous satellites receiving interference from the satellite signal transmitted from the transmission system to the first target satellite.

4. The transmission system for transmitting signals to geo-satellites as set forth in claim 2, wherein, with respect to the transmission system, a second target satellite is positioned at an orientation corresponding to the angle B and a third target satellite is positioned at an orientation corresponding to the angle C, and wherein the optimization module is further configured to transmit orthogonal satellite signals simultaneously to the second target satellite and to the third target satellite while continuing to transmit to the first target satellite without causing interference between the three target satellites, and wherein the user input criteria further comprises: the user inputting for the second target satellite a high gain beam peak at the angle B aimed at the second target satellite; the user inputting for the second target satellite a first null gain at the angle A aimed at the first target satellite; the user inputting for the second target satellite a second null gain at the angle C aimed at the third target satellite; the user inputting for the third target satellite a high gain beam peak at the angle C aimed at the third target satellite; the user inputting for the third target satellite a first null gain at the angle A aimed at the first target satellite; and the user inputting for the third target satellite a second null gain at the angle B aimed at the second target satellite.

5. The transmission system for transmitting signals to geo-satellites as set forth in claim 4, wherein, with respect to the transmission system, the first target satellite is positioned at the angle A equal to zero degrees, the second target satellite is positioned at the angle B equal to −0.5 degrees, and the third target satellite is positioned at the angle C equal to 2.0 degrees, and wherein for the first, second, and third target satellites the user inputs high gain beam peaks greater than 40 dB units and first and second null gains less than −30 dB units, and wherein for the first target satellite the user inputs a first null direction of −0.5 degrees and a second null direction of 2.0 degrees, for the second target satellite the user inputs a first null direction of zero degrees and a second null direction of 2.0 degrees, and for the third target satellite the user inputs a first null direction of zero degrees and a second null direction of −0.5 degrees.

6. A receiver system for receiving signals from geo-satellites, the receiver system comprising:

a plurality of directional receiver elements for aiming in the general direction of a target satellite;

a controller module communicatively connected with the directional receiver elements, the controller module including an optimization module configured to receive a satellite signal from the geo-satellites through the receiver elements, and based on signal parameters of the received satellite signal and on user input criteria, causing an adjustment of the signal parameters to meet the user input criteria, resulting in improved reception of a target satellite signal and reduced reception of undesired signals from extraneous satellites, wherein the user input criteria comprises: a user inputting a high gain beam peak at an angle A aimed from the target satellite, wherein with respect to the receiver system the target satellite is positioned at an orientation corresponding to the angle A; the user inputting a first null gain at an angle B; and the user inputting a second null gain at an angle C, wherein the angles A, B, and C are different from one another, whereby, with respect to the receiver system, a first extraneous satellite is positioned at an orientation corresponding to the angle B and a second extraneous satellite is positioned at an orientation corresponding to the angle C, without the undesired signals transmitted from the extraneous satellites causing interference with the satellite signal transmitted from the target satellite to the receiver system.

7. The receiver system as set forth in claim 6, wherein, with respect to the receiver system, a second target satellite is positioned at an orientation corresponding to the angle B and a third target satellite is positioned at an orientation corresponding to the angle C, and wherein the optimization module is further configured to receive orthogonal satellite signals simultaneously from the second target satellite and from the third target satellite while continuing to receive the satellite signal from the first target satellite without receiving interference between the received satellite signals from the three target satellites, and wherein the user input criteria further comprises: the user inputting for the second target satellite a high gain beam peak at the angle B, a first null gain at the angle A, and a second null gain at the angle C; and the user inputting for the third target satellite a high gain beam peak at the angle C, a first null gain at the angle A, and a second null gain at the angle B.

8. The receiver system as set forth in claim 7, wherein the signal parameters include amplitude and phase, and where the controller module adjusts the signal parameters utilizing an optimization technique selected from a group consisting of:

radio-frequency element weighting, wherein the element weighting is accomplished by RF amplitude and phase adjustment of the signals, resulting in weighted received signals, and coherently summing the weighted received signals;

baseband element analog weighting technique; and digital beamforming.

9. The receiver system as set forth in claim 7, wherein the directional receiver elements have adjustable element parameters which, when adjusted, adjust the signal parameters.

10. The receiver system as set forth in claim 7, wherein the adjustable element parameters are a mechanically-adjustable receiver element spacing.

11. The receiver system as set forth in claim 10, wherein such directional receiver elements are configured in a manner selected from a group consisting of fixed locations, re-locatable positions, and mobile positions.

12. The receiver system as set forth in claim 10, wherein the optimization module iteratively adjusts the adjustable element parameters by an algorithm based on the user input criteria until the signal parameters meet the user input criteria, and wherein the algorithm comprises a gradient search principles algorithm.

13. The receiver system as set forth in claim 12, wherein the signal parameters include amplitude and phase, and where the controller module adjusts at least one of the element parameters and the signal parameters utilizing an optimization technique selected from a group consisting of:

receiver element spacing perturbation;

radio-frequency element weighting, wherein the element weighting is accomplished by RF amplitude and phase adjustment of the signals, resulting in weighted received signals, and coherently summing the weighted received signals;

baseband element analog weighting technique; and digital beamforming (DBF).

14. The receiver system as set forth in claim 13, wherein, with respect to the receiver system, the first target satellite is positioned at the angle A equal to zero degrees, the second target satellite is positioned at the angle B equal to −0.5 degrees, and the third target satellite is positioned at the angle C equal to 2.0 degrees, and wherein for the first, second, and third target satellites the user inputs high gain beam peaks greater than 40 dB units and first and second null gains less than −30 dB units, and wherein for the first target satellite the user inputs a first null direction of −0.5 degrees and a second null direction of 2.0 degrees, for the second target satellite the user inputs a first null direction of zero degrees and a second null direction of 2.0 degrees, and for the third target satellite the user inputs a first null direction of zero degrees and a second null direction of −0.5 degrees.

15. The receiver system as set forth in claim 6, wherein the user inputs the high gain beam peak to be greater than 40 dB units at the angle A equal to zero degrees aimed from a first target satellite, the user inputs the first null gain to be less than −30 dB at the angle B equal to −0.5 degrees, and the user inputs the second null gain to be less than −10 dB at the angle C equal to 2 degrees, whereby, with respect to the receiver system, the first extraneous satellite is placed at an orientation corresponding to −0.5 degrees and the second extraneous satellite is placed at an orientation corresponding to 2 degrees, without the undesired signals transmitted from the extraneous satellites causing interference with the satellite signal transmitted from the target satellite to the receiver system.

16. A receiver optimization apparatus for receiving signals from geo-satellites, the apparatus comprising a controller module for receiving a satellite signal, having signal parameters, from a set of directional receiver elements, the controller system including an optimization module configured to receive the satellite signal, and based on signal parameters of the received satellite signal and on user input criteria, causing an adjustment of the signal parameters to meet the user input criteria, resulting in improved reception of a target satellite signal and reduced reception of undesired signals from extraneous satellites, wherein the user input criteria comprises: a user inputting a high gain beam peak at an angle A aimed from the target satellite, wherein with respect to the receiver optimization apparatus the target satellite is positioned at an orientation corresponding to the angle A; the user inputting a first null gain at an angle B; and the user inputting a second null gain at an angle C, wherein the angles A, B, and C are different from one another, whereby, with respect to the receiver optimization apparatus, a first extraneous satellite is positioned at an orientation corresponding to the angle B and a second extraneous satellite is positioned at an orientation corresponding to the angle C, without the undesired signals transmitted from the extraneous satellites causing interference with the satellite signal transmitted from the target satellite to the receiver optimization apparatus.

17. The apparatus as set forth in claim 16, wherein, with respect to the receiver optimization apparatus, a second target satellite is positioned at an orientation corresponding to the angle B and a third target satellite is positioned at an orientation corresponding to the angle C, and wherein the optimization module is further configured to receive orthogonal satellite signals simultaneously from the second target satellite and from the third target satellite while continuing to receive the satellite signal from the first target satellite without receiving interference between the received satellite signals from the three target satellites, and wherein the user input criteria further comprises: the user inputting for the second target satellite a high gain beam peak at the angle B, a first null gain at the angle A, and a second null gain at the angle C; and the user inputting for the third target satellite a high gain beam peak at the angle C, a first null gain at the angle A, and a second null gain at the angle B.

18. The apparatus as set forth in claim 17, wherein the signal parameters include amplitude and phase, and where the controller module adjusts the signal parameters utilizing an optimization technique selected from a group consisting of:

radio-frequency element weighting, wherein the element weighting is accomplished by RF amplitude and phase adjustment of the signals, resulting in weighted received signals, and coherently summing the weighted received signals;

baseband element analog weighting technique; and digital beamforming.

19. The apparatus as set forth in claim 17, wherein, based on the signal parameters, the controller module is configured to provide adjustment information for adjusting element parameters of the set of directional receiver elements.

20. The apparatus as set forth in claim 19, wherein the optimization module iteratively adjusts the adjustable element parameters by an algorithm based on the user input criteria until the signal parameters meet the user input criteria, and wherein the algorithm comprises a gradient search principles algorithm.

21. The apparatus as set forth in claim 20, wherein the signal parameters include amplitude and phase, and where the controller module adjusts at least one of the element parameters and the signal parameters utilizing an optimization technique selected from a group consisting of:

receiver element spacing perturbation;

radio-frequency element weighting, wherein the element weighting is accomplished by RF amplitude and phase adjustment of the signals, resulting in weighted received signals, and coherently summing the weighted received signals;

baseband element analog weighting technique; and

DBF.

22. The apparatus as set forth in claim 21, wherein, with respect to the receiver optimization apparatus, the first target satellite is positioned at the angle A equal to zero degrees, the second target satellite is positioned at the angle B equal to −0.5 degrees, and the third target satellite is positioned at the angle C equal to 2.0 degrees, and wherein for the first, second, and third target satellites the user inputs high gain beam peaks greater than 40 dB units and first and second null gains less than −30 dB units, and wherein for the first target satellite the user inputs a first null direction of −0.5 degrees and a second null direction of 2.0 degrees, for the second target satellite the user inputs a first null direction of zero degrees and a second null direction of 2.0 degrees, and for the third target satellite the user inputs a first null direction of zero degrees and a second null direction of −0.5 degrees.

23. The apparatus as set forth in claim 19, wherein such directional receiver elements are configured in a manner selected from a group consisting of fixed locations, re-locatable positions, and mobile positions.

24. The apparatus as set forth in claim 16, wherein the user inputs the high gain beam peak to be greater than 40 dB units at the angle A equal to zero degrees aimed from a first target satellite, the user inputs the first null gain to be less than −30 dB at the angle B equal to −0.5 degrees, and the user inputs the second null gain to be less than −10 dB at the angle C equal to 2 degrees, whereby, with respect to the receiver optimization apparatus, the first extraneous satellite is placed at an orientation corresponding to −0.5 degrees and the second extraneous satellite is placed at an orientation corresponding to 2 degrees, without the undesired signals transmitted from the extraneous satellites causing interference with the satellite signal transmitted from the target satellite to the receiver optimization apparatus.

25. A method for optimizing reception of signals from geo-satellites, the method comprising acts of:

receiving a satellite signal, having signal parameters, from a set of directional receiver elements;

based on signal parameters of the received satellite signal and on user input criteria, adjusting the signal parameters to meet the user input criteria, resulting in improved reception of a target satellite signal and reduced reception of undesired signals from extraneous satellites, wherein the user input criteria comprises: a user inputting a high gain beam peak at an angle A aimed from the target satellite, wherein with respect to the directional receiver elements the target satellite is positioned at an orientation corresponding to the angle A; the user inputting a first null gain at an angle B; and the user inputting a second null gain at an angle C, wherein the angles A, B, and C are different from one another, whereby, with respect to the directional receiver elements, a first extraneous satellite is positioned at an orientation corresponding to the angle B and a second extraneous satellite is positioned at an orientation corresponding to the angle C, without the undesired signals transmitted from the extraneous satellites causing interference with the satellite signal transmitted from the target satellite to the directional receiver elements.

26. The method as set forth in claim 25, wherein, with respect to the directional receiver elements, a second target satellite is positioned at an orientation corresponding to the angle B and a third target satellite is positioned at an orientation corresponding to the angle C, and wherein the optimization module is further configured to receive orthogonal satellite signals simultaneously from the second target satellite and from the third target satellite while continuing to receive the satellite signal from the first target satellite without receiving interference between the received satellite signals from the three target satellites, and wherein the user input criteria further comprises: the user inputting for the second target satellite a high gain beam peak at the angle B, a first null gain at the angle A, and a second null gain at the angle C; and the user inputting for the third target satellite a high gain beam peak at the angle C, a first null gain at the angle A, and a second null gain at the angle B.

27. The method as set forth in claim 26, further comprising an act of providing adjustment information based on the signal parameters for adjusting element parameters of the set of directional receiver elements.

28. The method as set forth in claim 27, in the act of adjusting the signal parameters, the adjustable element parameters are adjusted by an algorithm based on the user input criteria until the signal parameters meet the user input criteria, and wherein the algorithm comprises a gradient search principles algorithm.

29. The method as set forth in claim 28, wherein the signal parameters include amplitude and phase, where in the act of adjusting the signal parameters, at least one of the element parameters and the signal parameters is adjusted utilizing an optimization technique selected from a group consisting of:

receiver element spacing perturbation;

radio-frequency element weighting, wherein the element weighting is accomplished by RF amplitude and phase adjustment of the signals, resulting in weighted received signals, and coherently summing the weighted received signals;

baseband element analog weighting technique; and

DBF.

30. The method as set forth in claim 29, wherein, with respect to the directional receiver elements, the first target satellite is positioned at the angle A equal to zero degrees, the second target satellite is positioned at the angle B equal to −0.5 degrees, and the third target satellite is positioned at the angle C equal to 2.0 degrees, and wherein for the first, second, and third target satellites the user inputs high gain beam peaks greater than 40 dB units and first and second null gains less than −30 dB units, and wherein for the first target satellite the user inputs a first null direction of −0.5 degrees and a second null direction of 2.0 degrees, for the second target satellite the user inputs a first null direction of zero degrees and a second null direction of 2.0 degrees, and for the third target satellite the user inputs a first null direction of zero degrees and a second null direction of −0.5 degrees.

31. The method as set forth in claim 26, wherein the signal parameters include amplitude and phase, where in the act of adjusting the signal parameters, at least one of the element parameters and the signal parameters is adjusted utilizing an optimization technique selected from a group consisting of:

receiver element spacing perturbation;

radio-frequency element weighting, wherein the element weighting is accomplished by RF amplitude and phase adjustment of the signals, resulting in weighted received signals, and coherently summing the weighted received signals;

baseband element analog weighting technique; and

DBF.

32. The method as set forth in claim 25, wherein the user inputs the high gain beam peak to be greater than 40 dB units at the angle A equal to zero degrees aimed from a first target satellite, the user inputs the first null gain to be less than −30 dB at the angle B equal to −0.5 degrees, and the user inputs the second null gain to be less than −10 dB at the angle C equal to 2 degrees, whereby, with respect to the directional receiver elements, the first extraneous satellite is placed at an orientation corresponding to −0.5 degrees and the second extraneous satellite is placed at an orientation corresponding to 2 degrees, without the undesired signals transmitted from the extraneous satellites causing interference with the satellite signal transmitted from the target satellite to the directional receiver elements.

33. A computer program product for optimizing reception of signals from geo-satellites, the computer program product comprising computer-readable instructions stored on a computer-readable media for causing a signal processing system to perform acts comprising:

receiving a satellite signal, having signal parameters, from a set of directional receiver elements;

based on signal parameters of the received satellite signal and on user input criteria, adjusting the signal parameters to meet the user input criteria, resulting in improved reception of a target satellite signal and reduced reception of undesired signals from extraneous satellites, wherein the user input criteria comprises: a user inputting a high gain beam peak at an angle A aimed from the target satellite, wherein with respect to the directional receiver elements the target satellite is positioned at an orientation corresponding to the angle A; the user inputting a first null gain at an angle B; and the user inputting a second null gain at an angle C, wherein the angles A, B, and C are different from one another, whereby, with respect to the directional receiver elements, a first extraneous satellite is positioned at an orientation corresponding to the angle B and a second extraneous satellite is positioned at an orientation corresponding to the angle C, without the undesired signals transmitted from the extraneous satellites causing interference with the satellite signal transmitted from the target satellite to the directional receiver elements.

34. The computer program product as set forth in claim 33, wherein, with respect to the directional receiver elements, a second target satellite is positioned at an orientation corresponding to the angle B and a third target satellite is positioned at an orientation corresponding to the angle C, and wherein the signal processing system further performs the act of receiving orthogonal satellite signals simultaneously from the second target satellite and from the third target satellite while continuously receiving the satellite signal from the first target satellite without receiving interference between the received satellite signals from the three target satellites, and wherein the user input criteria further comprises: the user inputting for the second target satellite a high gain beam peak at the angle B, a first null gain at the angle A, and a second null gain at the angle C; and the user inputting for the third target satellite a high gain beam peak at the angle C, a first null gain at the angle A, and a second null gain at the angle B.

35. The computer program product as set forth in claim 34, further comprising computer-readable instructions on the computer-readable media for causing the data processing system to perform an act of providing adjustment information based on the signal parameters for adjusting element parameters of the set of directional receiver elements.

36. The computer program product as set forth in claim 35, in the act of adjusting the signal parameters, the adjustable element parameters are adjusted by an algorithm based on the user input criteria until the signal parameters meet the user input criteria, and wherein the algorithm comprises a gradient search principles algorithm.

37. The computer program product as set forth in claim 36, wherein the signal parameters include amplitude and phase, where in the act of adjusting the signal parameters, at least one of the element parameters and the signal parameters is adjusted utilizing an optimization technique selected from a group consisting of:

receiver element spacing perturbation;

radio-frequency element weighting, wherein the element weighting is accomplished by RF amplitude and phase adjustment of the signals, resulting in weighted received signals, and coherently summing the weighted received signals;

baseband element analog weighting technique; and

DBF.

38. The computer program product as set forth in claim 37, wherein, with respect to the directional receiver elements, the first target satellite is positioned at the angle A equal to zero degrees, the second target satellite is positioned at the angle B equal to −0.5 degrees, and the third target satellite is positioned at the angle C equal to 2.0 degrees, and wherein for the first, second, and third target satellites the user inputs high gain beam peaks greater than 40 dB units and first and second null gains less than −30 dB units, and wherein for the first target satellite the user inputs a first null direction of −0.5 degrees and a second null direction of 2.0 degrees, for the second target satellite the user inputs a first null direction of zero degrees and a second null direction of 2.0 degrees, and for the third target satellite the user inputs a first null direction of zero degrees and a second null direction of −0.5 degrees.

39. The computer program product as set forth in claim 34, wherein the signal parameters include amplitude and phase, where in the act of adjusting the signal parameters, at least one of the element parameters and the signal parameters is adjusted utilizing an optimization technique selected from a group consisting of:

receiver element spacing perturbation;

radio-frequency element weighting, wherein the element weighting is accomplished by RF amplitude and phase adjustment of the signals, resulting in weighted received signals, and coherently summing the weighted received signals;

baseband element analog weighting technique; and

DBF.

40. The computer program product as set forth in claim 33, wherein the user inputs the high gain beam peak to be greater than 40 dB units at the angle A equal to zero degrees aimed from a first target satellite, the user inputs the first null gain to be less than −30 dB at the angle B equal to −0.5 degrees, and the user inputs the second null gain to be less than −10 dB at the angle C equal to 2 degrees, whereby, with respect to the directional receiver elements, the first extraneous satellite is placed at an orientation corresponding to −0.5 degrees and the second extraneous satellite is placed at an orientation corresponding to 2 degrees, without the undesired signals transmitted from the extraneous satellites causing interference with the satellite signal transmitted from the target satellite to the directional receiver elements.

* * * * *